United States Patent [19]

Bowman

[11] Patent Number: 5,017,153

[45] Date of Patent: May 21, 1991

[54] MEMBRANE FOR OUTLET FITTINGS

[75] Inventor: Timothy S. Bowman, Parkersburg, W. Va.

[73] Assignee: Butler Manufacturing Company, Kansas City, Mo.

[21] Appl. No.: 569,966

[22] Filed: Aug. 20, 1990

Related U.S. Application Data

[63] Continuation of Ser. No. 391,947, Aug. 10, 1989, abandoned.

[51] Int. Cl.[5] ..... H01R 13/00

[52] U.S. Cl. ..... 439/426; 439/135

[58] Field of Search ..... 439/135, 136, 137, 426

[56] References Cited

U.S. PATENT DOCUMENTS 2,858,518 10/1958 Chrystie et al. ..... 439/426

3,845,234 10/1974 Brenner ..... 439/426

FOREIGN PATENT DOCUMENTS 950206 10/1956 Fed. Rep. of Germany ..... 439/426

604241 4/1960 Italy ..... 439/426

*Primary Examiner*—Joseph H. McGlynn

[57] ABSTRACT

Membrane for floor outlet fitting is made of material which is flexible and which has memory. Membrane is structured to allow the blades of an electrical plug to penetrate and engage the contacts of a receptacle covered by the membrane. Also, the membrane is structured to allow low tension cable to penetrate and be forced through. The membrane covers the receptacle and the floor opening and shields against dirt and passage of smoke. Membrane is used in a floor fitting by being positioned over a receptacle-carrying plate and held fast on the plate by a cap.

12 Claims, 2 Drawing Sheets

MEMBRANE FOR OUTLET FITTINGS

This application is a continuation of application Ser. No. 391,947 filed 8/10/89, now abandoned.

This invention relates in general to electrical underfloor or infloor power and communication systems for office buildings and the like.

Conventionally, such systems employ ducts or cellular raceways to carry low and high tension cables which are joined with floor outlet fittings to service work stations on the floor. Such systems may also employ poke-thru devices having floor outlets or service fittings to service the work stations.

Such floor outlets or service fittings may be the above-the-floor type or the flush-type and provide for high tension service (power) and for low tension service (telephone, data, and computer) at the floor.

The principal object of the invention is to provide, for flush-type floor outlets or service fittings, a membrane which functions as a shield and which for electrical activation purposes is penetrable by the blades of an electric plug and by low tension cable and which is self-closing when the blades or the cable are removed.

Flush outlet fittings are conventionally connected to presets or aftersets or to poke-thrus and provide high tension and low-tension service at work stations on the floor. High tension service is usually available through a single or dual duplex receptacle and low tension service is made available via appropriate cable.

For disclosure purposes, I have chosen to illustrate the invention in connection with: (a) a flush outlet fitting which may be connected to a preset or afterset passing power cable only, the fitting having a single duplex receptacle for connection to power cable; and (b) a poke-thru passing high and low tension cable, the fitting having a pair of duplex-receptacles for connection to power cable and opening means for exit of low tension cable.

As the description proceeds, it will be evident to those skilled in the art that the membrane can be employed in other arrangements of flush floor fittings.

The invention and the several advantages thereof will be apparent to those skilled in the art from the description and drawings below wherein.

Figure 1:
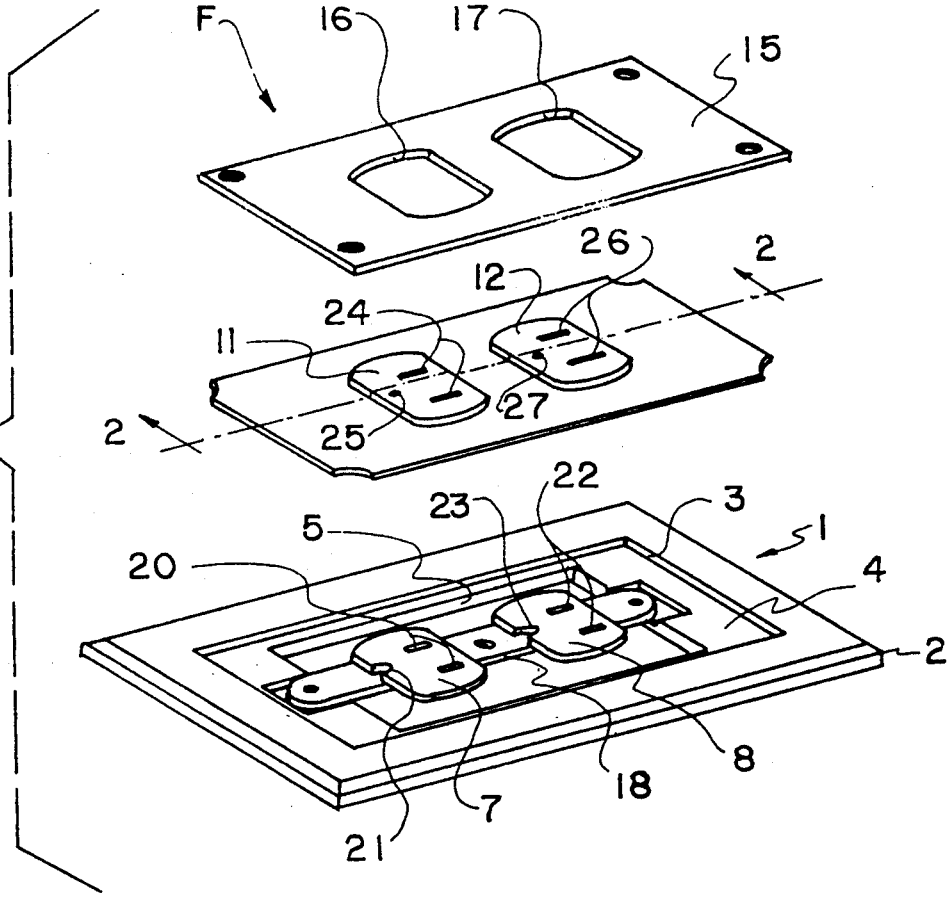
FIG. 1 is an exploded view showing the membrane as employed with a flush-type outlet fitting.

The outlet fitting F is adapted to be mounted over an opening in a concrete floor (not shown) and includes annular means 1 in the form of a ring whose peripheral edge 2 is adapted to rest on the floor covering which usually is carpet. The ring is dimensioned so that the top of the ring is substantially flush with the carpet. The ring 1 is structured to be connected to an afterset or to a preset in the concrete floor. While I have shown the assembly of FIG. 1 to be generally rectangular in plan, it will be understood that the assembly may have a round configuration depending on the nature of the insert.

The components referred to above but unnumbered are not illustrated as they are known and understood by those skilled in the art.

The ring 1 has a well 3 at the bottom of which is a shoulder 4 forming an opening or passageway 5 aligned with the opening in the concrete floor. The opening or passageway 5 accommodates the passage of electrical cable. A duplex receptacle 6 is mounted on the shoulder 4 and extends across the opening 5. The receptacle 6 is conventional and includes the raised sections 7 and 8.

A membrane 10 is dimensioned to be mounted in the well 3 on the shoulder 5 and extend across the opening 4 and over the receptacle 6. The membrane functions as a shield by closing off the opening 4 and covering the receptacle 6.

Figure 2:
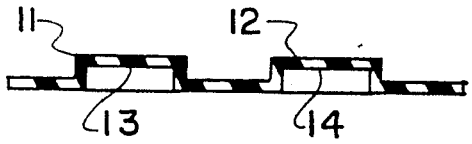
FIG. 2 is an exploded view of the membrane as taken along the lines 2—2 of FIG. 1.

The membrane 10 has sections 11 and 12 forming cavities 13 and 14 (FIG. 2) which fit over the raised sections 7 and 8 on the receptacle.

A lid 15 is dimensioned to fit into the well 3 over the membrane 10. The lid has access openings 16 and 17 which receive the raised sections 11 and 12 of the membrane. Hold down screws secure the lid to the shoulder 4 with the membrane squeezed between same. The undersides of sections 11 and 12 on the membrane are in contact with the tops of the receptacle sections 7 and 8. Also, the horizontally extending portions 18 of the receptacle are in contact with the underside of the membrane. The contacting or engaging portions of membrane around the shoulder 4 and the contacting or engaging portions of the membrane effectively function as gasket means.

Referring to the receptacle 16, the raised sections 7 and 8 contain contacts which are accessible through blade apertures and ground pin apertures. Thus, the section 7 has blade aperatures 20 and grounding pin aperture 21. The section 8 has blade aperture 22 and grounding pin aperture 23.

Referring to the membrane 10, the tops of the sections 11 and 12 are flat and each is provided a pair of normally closed slits and a small hole. The section 11 has slits 24 and hole 25. The section 12 has slits 26 and hole 27.

The slits and hole in the membrane section 11 or section 12 permit the blade and ground pin of an electrical plug to pass through membrane and be plugged into a receptacle.

Thus, as the membrane is mounted over the receptacle, the membrane slits 24 are aligned with receptacle apertures 20 and the grounding pin hole 25 aligned with receptacle aperture 21. Similarly, in the raised section 12, the slits 26 are aligned with apertures 22 and the opening 27 aligned with the pin aperture 23.

The membrane 10 is molded from material which is flexible and which has memory. The term memory means that if a force is exerted on a portion of the material and the force is of a magnitude sufficient to displace the portion, a force which is opposite to the displacement force will be built up in the portion. So, upon removal of the displacing force, the internal force will cause the portion to return to its original condition.

A preferred material is ethylene-propylenediene (called EPDM in the trade). This material is considered a general purpose synthetic rubber and in addition to flexibility and memory has good electrical insulating properties, good tear and wear resistance, and is easy to mold in various shapes and thicknesses. Several manufacturers produce EPDM, for example, NORDEL by DuPont and EPCAR by B. F. Goodrich.

The slits and the gounding pin hole are formed after the membrane is molded, the slits being made by razor-like knives and the holes being punched. p Each slit has a pair of opposing facing walls which are normally engaged but which can be separated by the insertion of the blades of an electrical plug. The flexibility of the material permits the walls to be separated. As the walls are moved, opposing forces are built up in the areas adjacent the walls. When the blades are removed, the internal forces will cause the slits to close or return to the original condition.

Thus, it will be apparent that the membrane is configured so as to permit the blades of an electrical plug to penetrate or be forced through the membrane so as to enter the apertures in a receptacle and engage the contacts there. Further, it will be apparent that the memory of the membrane provides that when the blades are removed, the membrane assumes the closed condition.

The contacts in receptacles which are accessed by apertures 20 and 22 are "hot" or power energized. It is desirable that these openings be shielded from debris such as dush and dirt particles and also shielded from water. The sections 11 and 12 of the membrane covering the raised sections 7 and 8 provide a particle and water shield since the slits are closed. When the blades of an electrical plug are inserted through the slits and into the receptacle, the walls of the slits engage the blades and the function is maintained. The holes 25 and 27 in the membrane are in alignment with the grounding pin holes 21 and 23. This open condition is not serious inasmuch as the holes 26 and 27 are small and the grounding contact in the receptacle is not energized.

The EPDM material will tolerate intermittent temperatures up to 400° F. which happens to be the approximate maximum temperature for a fire rated floor. Thus, in a fire, the membrane will remain intact until after floor failure and has the important function of preventing the transfer of smoke to the floor above. The actual maximum temperature permitted by Underwriters Laboratories is the ambient temperature plus 325° F.

Figure 6:
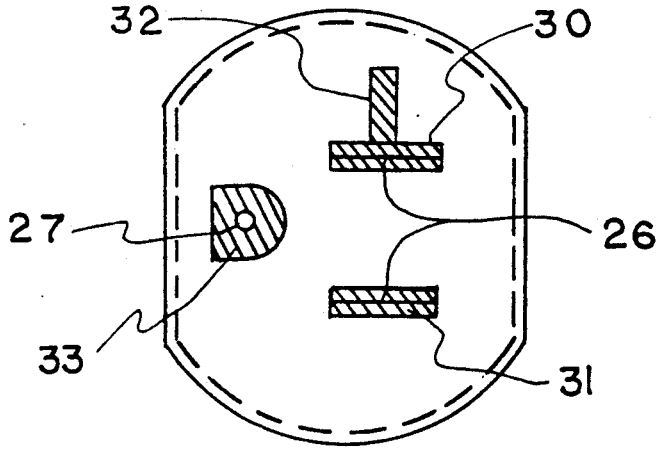
FIG. 6 is a fragmentary plan view of a portion of a membrane and illustrating certain identification means as preferably used on the membrane.

The slits 24 and 26 in the membrane are so thin that the same are not readily seen by the eyes. For easy locating purposes, identification means used as shown in FIG. 6 by visible patterns 30 and 31 around the slits 26. The pattern 30 has an extension 32 which will surround a slit when a 20 amp receptacle is employed. The hole 27 is provided with a pattern 33. The patterns 30 and 31 are preferably formed by conventional silk screening processes. Paint is the preferred material since it will bend.

I have not shown the slit and hole patterns in any of the other views, but it will be understood these other slits and holes have locating indicia.

Figure 3:
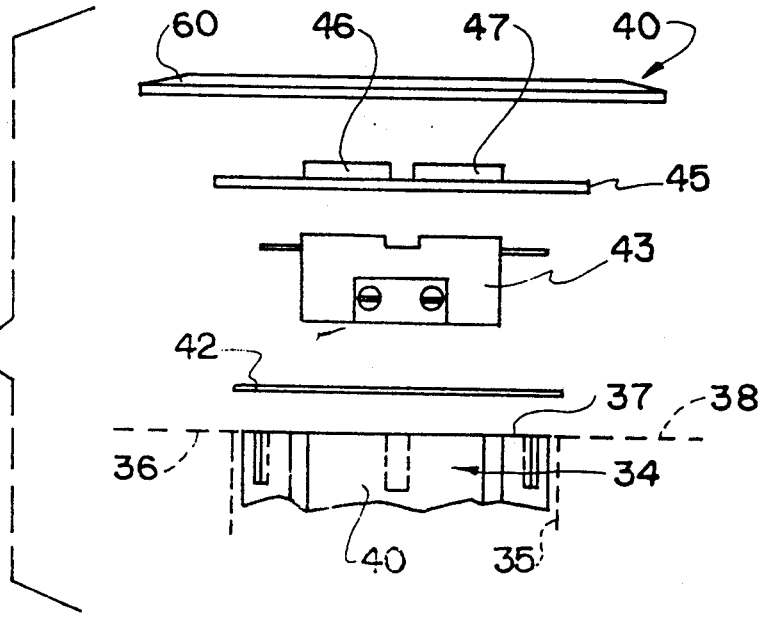
FIG. 3 is an exploded view showing the membrane as employed with a flush-type outlet fitting adapted for use with a poke-thru.
Figure 4:
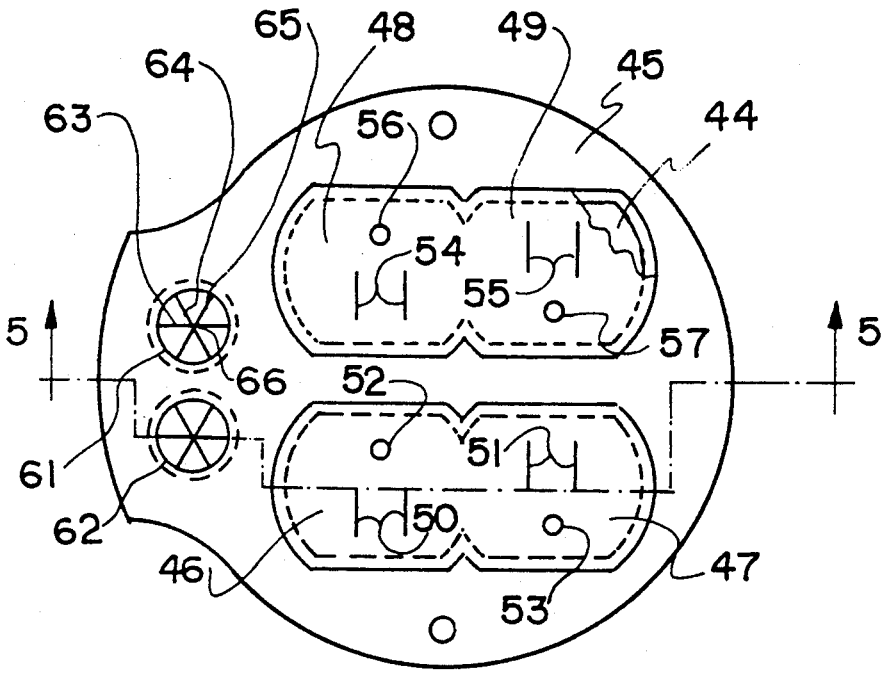
FIG. 4 is a plan view of the membrane employed in the arrangement of FIG. 3.
Figure 5:
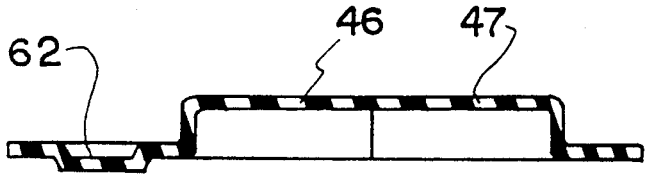
FIG. 5 is a sectional view taken along the lines 5—5 of FIG. 4.

In FIG. 3, I have illustrated the membrane of the invention as applied to a poke-thru to provide high and low tension service at the floor.

The poke-thru has a circular body 34 which is adapted to be positioned in a bore or opening 35 in a concrete floor 36. The top 37 of the body is flush with the floor surface 38. The body 34 has opening means including a central opening 40 for passage of high tension cable and a pair of side openings not shown for passage of low tension cable.

The floor outlet 41 includes a flat circular receptacle support plate 42 which is connected to the body 34 and is adapted to rest on the floor surface 38. The support plate 42 has an opening to receive the double duplex receptacle 43 which is secured to the support plate. A second double duplex 44 (FIG. 44) is likewise mounted on and secured to the support plate 42. The receptacles have the same construction as the receptacle 6 previously described. The support plate 42 also has openings (not shown) for passage of the high and low tension cable.

The membrane 45, which is generally circular, is made of the same material as the membrane 10. The pair of cavity-forming sections 46 and 47 have the same structure as sections 11 and 12 except for slit and hole orientation. The pair of cavity-forming sections 48 and 49 also have a structure the same as sections 11 and 12 except for slit and hole orientation.

The slits in the raised sections 46 and 47 to accommodate the blades of an electrical plug are indicated at 50 and 51 and the grounding pin openings at 52 and 53. The slits in sections 48 and 49 to accommodate the blades of an electrical plug are indicated at 54 and 55 and the grounding pin openings at 56 and 57.

The membrane 45 is adapted to fit down over the receptacles 43 and 44 with the raised sections of the receptacle being received in the cavity sections 46–49. As will be apparent, the membrane 45 covers the receptacles and extends across the central opening 40 and the bore 35.

A substantially flat annular plate means 60 is adapted to fit down over the membrane 45 and has clearance apertures to receive the raised sections on the membrane. The plate means is secured to the body 34 and maintains the underside of the membrane tight against the receptacles and support plate. The plate means 60 has openings for the passage of low tension cable.

The membrane 45 includes slit means providing for the passage of low tension cable. These slit means are located in the flat, recessed cable sections 61 and 62.

In the cable section 61 the slit means comprises three slits 63, 64, and 65. These slits 63, 64, and 65 respectively run along the diameter of a circle and form a radial pattern. The center of the circle is indicated by the dot 66. The slits 63, 64, and 65 are equally spaced. The slit means in the cable section 62 has an identical construction.

Like the slits of the membrane 10, the slits 63, 64, and 65 have facing walls which normally engage so as to be in closed condition.

The flat, pie-shaped material between adjacent slits, being flexible, can be moved or bent upwardly or downwardly so that the walls part and the slits are in an open condition.

With the forgoing structure, the end of a cable can be directed out of the center 66 and engage the pie-shaped material between adjacent slits and move through the section by bending the pie-shaped sections out of the flat condition.

The bent pie-shaped sections hug the side of the cable so as to substantially maintain a closed condition.

When the cable is removed, the memory of the material causes the pie-shaped sections to return to the flat condition and the slits are closed.

With the blade slits 50, 51, 54, and 55 and the cable slits 63, 64, and 65 functioning as described, the membrane 44 functions as a shield.

From the foregoing description, it will be apparent that cable sections 61 and 62 are configured to provide for the end of a low tension electrical cable to engage and be forced through the membrane.

I claim:

1. A penetrable membrane for use in a flush floor outlet fitting to be disposed at the surface of a concrete floor and mounting an electrical receptacle horizontally and substantially flush with said surface comprising:

a body made of material which is flexible and which has memory;

said body having first means providing for the blades of an electrical plug to engage and be forced through the first means to engage the contacts in said electrical receptacle; and said body having second means providing for the end of an electrical low-tension cable to engage the second means and be forced through the second means.

2. In combination:

a concrete floor having an opening for the passage of cable;

a receptacle having at least one raised section including internal contacts and aperture providing access to the contacts;

mounting means mounting said receptacle in said floor opening with the top of the raised section substantially flush with the floor surface;

membrane means disposed over said receptacle, the membrane being made of material characterized by being flexible and having memory;

said membrane means having at least one receptacle section forming a cavity, the cavity receiving said raised section of said receptacle;

said membrane means having at least one cable section for the passage of cable;

said membrane receptacle section providing for the blades of an electrical plug to engage and be forced through the section to enter said apertures and engage the said receptacle contacts; and said cable section providing for the end of an electrical cable to engage and be forced through the cable section.

3. In an outlet fitting for use with a flush poke-thru:

receptacle means having at least one raised section having internal contacts and apertures providing access to the contacts;

means mounting said receptacle so that the receptacle is disposable within a bore in concrete floor with the top of the raised section substantially flush with the floor surface;

said membrane means being made of material characterized by being flexible and having memory;

said membrane means having at least one receptacle section forming a cavity, the cavity receiving said raised section of said receptacle;

said membrane means having at least one cable section for the passage of an electrical cable;

said membrane receptacle section providing for the blades of an electrical plug to engage and be forced through the section to enter said apertures and engage the said receptacle contacts; and said cable section being providing for the end of an electrical cable to engage and be forced through the cable section.

4. A penetrable membrane for use in a flush floor outlet fitting to be disposed at the surface of a concrete floor and mounting an electrical receptacle horizontally and substantially flush with said surface comprising:

a body made of material which is flexible and which has memory;

first slit means in said body and extending therethrough and forming facing walls;

second slit means comprising a plurality of slits, each slit forming facing walls extending through the center of and respectively along a diameter of a circle to form a radial pattern; and said body material providing for each said slit means to assume a closed condition wherein the facing walls are in engagement and for the slit means to be placed in a open condition wherein facing walls are spaced from one another.

5. A penetrable membrane for a floor outlet fitting;

a body having interconnected first and second sections, the body being made of material characterized by being flexible and having memory;

a pair of substantially closed slits extending through said first section, the slits and the flexibility of the material providing for the blades of an electrical plug to part the slits and enter and pass through the first section and when the blades are removed, the memory of the material providing for the slits to return substantially to the closed condition prior to said entry of the blades and;

a plurality of substantially closed slits in said second section, each slit extending through the center of and respectively along a diameter of a circle to form a radial pattern, the slits of the pattern and the flexibility of the material providing for an electrical cable to engage the material between adjacent slits and bend same so the cable can pass through the slits and when the cable is removed, the memory of the material provides for the slits to return substantially to said closed condition prior to entry for the cable.

6. In a floor outlet fitting having opening means and receptacle means in the opening means, the receptacle means having internal contacts and apertures providing access to the contacts and the opening means being structured for the passage of cable:

membrane means made of material characterized by being flexible and having memory;

said membrane means extending across said opening means and over said receptacle means to provide a shield for the opening means and the receptacle means;

the membrane including a plurality of slits and the flexibility of the membrane providing that the blades of an electrical plug can be passed through first selected slits to enter said apertures and engage said receptacle contacts and providing that an electrical cable can be passed through second selected slits and with said passage of blades and cable, the membrane means substantially retaining said shield function; and the memory of the material providing that upon removal of the blades, the slits return to the condition of providing, said shield for said opening and said receptacle means.

7. In a floor outlet fitting having opening means and receptacle means in the opening means the receptacle means having internal contacts and aperture providing access to the contacts and the opening means being structured for the passage of cable:

membrane means made of material characterized by being flexible and having memory;

said membrane means extending across said opening means and over said receptacle means to provide a shield for the opening means and the receptacle means; and the membrane including a plurality of slits and the flexibility of the membrane providing that the blades of an electrical plug can be passed through first selected slits to enter said apertures and engage said receptacle contacts and providing that an electrical cable can be passed through second selected slits and with said passage of blade and cable, the membrane means substantially retaining said shield function.

8. A penetrable membrane for use in a flush floor outlet fitting to be disposed at the surface of a concrete floor and mounting an electrical receptacle horizontally and substantially flush with said surface comprising:

membrane means made of material characterized by being flexible and having memory;

said membrane means having at least one receptacle section;

said membrane means having at least one cable section for the passage of cable;

said receptacle section providing for the blades of an electrical plug to engage and be forced through the section to enter said apertures and engage the said receptacle contacts; and said cable section providing for the end of an electrical cable to engage and for the cable to be forced through the cable section.

9. A subcombination for use in a flush floor outlet fitting to be disposed at the surface of a concrete floor, the subcombination comprising:

receptacle support means having opening means and a peripheral edge for resting on the surface of a concrete floor;

receptacle means secured to said support means and having at least one raised section in said opening means, the raised section including internal contacts and apertures providing access to the contacts;

membrane means mounted on said receptacle support means around said opening means and over said receptacle means, the membrane means having at least one receptacle section forming a cavity, the cavity receiving said raised section;

said receptacle section providing for the blades of an electrical plug to engage and be forced through the section to enter said apertures and engage said contacts; and lid means mounted on said membrane means and secured to said receptacle support means and holding the membrane means in place, the lid means having access opening means which receives said receptacle section of the membrane.

10. A subcombination for use in a flush floor outlet fitting to be disposed at the surface of a concrete floor, the subcombination comprising:

annular receptacle support means having opening means and a peripheral edge for resting on the surface of a concrete floor;

at least one duplex receptacle means secured to said receptacle support means and extending in said opening means, the receptacle means having a pair of raised sections each section including contacts and apertures providing access to the contacts;

membrane means mounted on a said receptacle support means and extending across said opening means to close off the opening means and extending over said receptacle means to cover the receptacle means and each receptacle section providing for the blades of an electrical plug to engage and be forced through the section to enter said apertures and engage said contacts; and lid means mounted on said membrane means and secured to said receptacle support means to hold the membrane means in place, the lid means having at least a pair of access openings which respectively receive said receptacle sections of the membrane.

11. A subcombination for use in a poke thru type flush floor outlet fitting to be disposed at the surface of a concrete floor, the subcombination comprising:

plate means having opening means for the passage of low tension cable therethrough and for receiving receptacle means, the plate means having a peripheral edge for resting on the floor surface;

at least one duplex receptacle means extending in said opening means and secured to said plate means, the receptacle means having a pair of raised sections each section including contacts and apertures providing access to the contacts;

membrane means mounted on said plate means and extending across said opening means to close off the opening means and extending over said receptacle means to cover the receptacle means, the membrane means having at least a pair of receptacle section each forming a cavity, the cavities respectively receiving said raised sections and the receptacle sections each providing for the blades of an electrical plug to engage and be forced through the section to enter said apertures and engage said contacts;

the membrane means having at least one cable section for the passage of electrical cable, the cable section providing for the end of low tension cable to engage and be forced through the cable section; and lid means mounted on said membrane means and secured to said plate means and holding the membrane means in place, the lid means having access opening means which receives said receptacle sections of the membrane and opening means for the passage of low tension cable extending through the membrane means.

12. A subcombination for use in a poke thru type flush floor outlet fitting to be disposed at the surface of a concrete floor, the subcombination comprising:

plate means having opening means for the passage of low tension cable therethrough and for receiving receptacle means, the plate means having a peripheral edge for resting on the floor surface;

at least one duplex receptacle means extending in said opening means and secured to said plate means, the receptacle means having a pair of raised sections each section including contacts and apertures providing access to the contacts;

membrane means mounted on said plate means and extending across said opening means to close off the opening means and extending over said receptacle means to cover the receptacle means, the membrane means having at least a pair of receptacle sections each forming a cavity, the cavities respectively receiving said raised sections and the receptacle sections each providing for the blades of an electrical plug to engage and be forced through the section to enter said apertures and engage said contacts; and the membrane means having at least one cable section for the passage of electrical cable, the cable section providing for the end of low tension cable, to engage and be forced through the cable section.

* * * * *